US010001345B2

(12) United States Patent
Geissele et al.

(10) Patent No.: US 10,001,345 B2
(45) Date of Patent: Jun. 19, 2018

(54) FIREARM ACCESSORY MOUNT

(71) Applicant: WHG Properties, LLC, North Wales, PA (US)

(72) Inventors: William H. Geissele, Lower Gwynedd, PA (US); Frank E. Robinson, Schwenksville, PA (US)

(73) Assignee: WHG Properties, LLC, North Wales, PA (US)

( * ) Notice: Subject to any disclaimer, the term of this patent is extended or adjusted under 35 U.S.C. 154(b) by 102 days.

(21) Appl. No.: 15/279,044

(22) Filed: Sep. 28, 2016

(65) Prior Publication Data

US 2018/0058815 A1 Mar. 1, 2018

Related U.S. Application Data

(63) Continuation-in-part of application No. 29/575,465, filed on Aug. 25, 2016.

(51) Int. Cl.

| | |
|---|---|
| ***F41A 3/00*** | (2006.01) |
| ***F41G 11/00*** | (2006.01) |
| ***F41A 5/26*** | (2006.01) |
| ***F41A 3/66*** | (2006.01) |

(52) U.S. Cl.

CPC ..... *F41G 11/003* (2013.01); *F41A 3/66* (2013.01); *F41A 5/26* (2013.01); *F41G 11/007* (2013.01); *F41G 11/008* (2013.01)

(58) Field of Classification Search

CPC .... F41G 11/003; F41G 11/007; F41G 11/008; F41A 3/66; F41A 5/26

USPC ..... 42/72, 124

See application file for complete search history.

(56) References Cited

U.S. PATENT DOCUMENTS

| | | | |
|---|---|---|---|
| 5,941,489 | A | 8/1999 | Fanelli |
| D435,885 | S | 1/2001 | Wallace |
| D486,878 | S | 2/2004 | Selvaggio |
| D510,120 | S | 9/2005 | Ding |
| D511,365 | S | 11/2005 | Ding |
| D513,298 | S | 12/2005 | Ding |
| D513,299 | S | 12/2005 | Ding |
| D533,618 | S | 12/2006 | Swan |

(Continued)

OTHER PUBLICATIONS

Aluminum Alloy Extension Gun Rail Mount or M4A1 I M16-Black, DX.com [online], [site visited on Jun. 19, 2017]. URL: http://www.dx.com/p.alum in u m-alloy-extension-gun-rail-mou nt-for-m4a 1-m 16-black-16834#. WUguHf7rtmM.

(Continued)

*Primary Examiner* — Samir Abdosh

(74) *Attorney, Agent, or Firm* — Fox Rothschild LLP

(57) ABSTRACT

A firearm accessory includes a firearm attachment portion that is configured to attach to a firearm. The firearm attachment portion defines a barrel passage that defines a barrel passage axis. The barrel passage is configured to receive at least a portion of a firearm barrel. The firearm accessory includes an accessory mounting portion that is pivotally attached to the firearm attachment portion. The accessory mounting portion is movable between an open position and a closed position. When in the open position, the accessory mounting portion is positioned away from the barrel passage, and when in the closed position, the accessory mounting portion is positioned at least partially around the barrel passage.

17 Claims, 14 Drawing Sheets

(56) References Cited

U.S. PATENT DOCUMENTS

| | | | | |
|---|---|---|---|---|
| D537,901 | S | 3/2007 | Elkaim | |
| D542,880 | S | 5/2007 | Cheng | |
| D543,605 | S | 5/2007 | Cheng | |
| D548,811 | S | 8/2007 | Swan | |
| 7,367,152 | B2 * | 5/2008 | Samson | F41C 27/00 42/128 |
| D577,094 | S | 9/2008 | Wallace | |
| 7,481,016 | B2 | 1/2009 | Gonzalez | |
| D606,155 | S | 12/2009 | Swan | |
| D630,698 | S | 1/2011 | Peterson | |
| D637,683 | S | 5/2011 | Salsman | |
| 8,104,211 | B2 | 1/2012 | Darian | |
| D654,134 | S | 2/2012 | Edge | |
| D654,135 | S | 2/2012 | Edge | |
| D674,860 | S | 1/2013 | Deros | |
| 8,341,866 | B1 * | 1/2013 | Gaddini | F41G 11/003 42/71.01 |
| D676,095 | S | 2/2013 | Peterson | |
| 8,510,983 | B2 * | 8/2013 | Larue | F41G 11/003 42/124 |
| D709,582 | S | 7/2014 | Geissele | |
| 8,857,097 | B2 * | 10/2014 | Rorick | F41G 11/003 42/114 |
| 8,898,948 | B1 * | 12/2014 | Gaddini | F41G 11/003 42/71.01 |
| D725,223 | S | 3/2015 | Heidkamp | |
| 9,015,982 | B1 | 4/2015 | Powers | |
| D732,628 | S | 6/2015 | Cheng | |
| D737,923 | S | 9/2015 | Norberg | |
| D737,925 | S | 9/2015 | Norberg | |
| D738,986 | S | 9/2015 | Anderson | |
| D739,912 | S | 9/2015 | Norberg | |
| 9,285,186 | B1 | 3/2016 | Di Veroli | |
| D761,929 | S | 7/2016 | Hormann | |
| 2006/0162227 | A1 * | 7/2006 | Samson | F41C 27/00 42/148 |
| 2007/0199225 | A1 | 8/2007 | Haugen | |
| 2008/0005952 | A1 | 1/2008 | Sutherby | |
| 2009/0038201 | A1 | 2/2009 | Cheng | |
| 2011/0192068 | A1 * | 8/2011 | Samson | F41C 27/00 42/90 |
| 2011/0197491 | A1 | 8/2011 | McCann | |
| 2013/0008073 | A1 | 1/2013 | Clifton | |
| 2013/0036650 | A1 * | 2/2013 | Larue | F41G 11/003 42/148 |
| 2013/0185985 | A1 | 7/2013 | Ballard | |
| 2013/0312309 | A1 * | 11/2013 | Rorick | F41G 11/003 42/114 |
| 2015/0198397 | A1 | 7/2015 | Motley | |
| 2016/0033234 | A1 | 2/2016 | Swift | |
| 2016/0102946 | A1 | 4/2016 | Sharron | |
| 2016/0102947 | A1 | 4/2016 | Visinski | |
| 2017/0023333 | A1 | 1/2017 | Faifer | |
| 2017/0059280 | A1 | 3/2017 | Fravor | |

OTHER PUBLICATIONS

Aim Sports Saiga 12g Quad Rail Mount with Covers, MountsPlus.com, [online], [site visited Jun. 19, 2017]. URL: http://ww.mountsplus.com/AR-15_Accessories/AR-15_Scope_Rings/136-AIMS-MTSG02.html.

H&R1871 Nef Pardner Pump Shotgun Scope Base Rail Mount, TrinitySupply.com, [online], [site visited Jun. 19, 2017]. URL: https://www.trinitysupply.com/H-R-1871-shotgun-saddle-mount-p/tr295.htm.

Ultimate Arms Gear Tactical Heavy Duty, Scope Sight Red Dot Weaver Picatinny Rail Mount, [online], [site visited Jun. 19, 2017]. URL: http://ultimatearmsgear.com/products/ultimate-arms-gear-tactical-heavy-d uty-scope-sight-red-dot-weaver-picatinny-rai 1-mount-for-the-m 14-m-14-m 1 a-norinco-m305-battle-rifle.

FN-FN Picatinny Direct Thread USG Side Rail Aluminum,Brownells.com, [online], [site visited Jun. 19, 2017]. URL: http://www.brownells.com/rifle-parts/forend-amp-handguard-parts/handguards-amp-rails/fn-picatinny-direct-thread-usg-side-rail-aluminum-prod72446.aspx.

EGW HD 1-piece Picatinny-Style, Scope Base 11 mm Dovetail Adapter CZ 452, 453, 455, 511 Matte, MidwayUSA.com, [online],[site visited Jun. 19, 2017]. URL: https://www.midwayusa.com/product/1018817933/egw-hd-1-piece-picatinny-style-scope-base-11 mm-dovetail-adapter-cz-452-453-455-511-matte.

Sadlak Scope Mount M1A, M14 Matter, MidwayUSA.com, [online], [site visited Jun. 19, 2017]. URL: https://www.midwayusa.com/product/2959580945/sadlak-scope-mount-m1a-m14-matte.

ArmaDynamics, PKM-RAP Mount, Amazon.com, [online], [site visited Jun. 19, 2017]. URL: https://www.amazon.com/Armadynam ics-ArmaDynam ics-PKM-RAP-Mount/dp/B003J I IVS8/ref=sr _ 1_189?s= h u nting-fishing&ie=UTF8&qid= 1497904857&sr=1-189&refi nements=p_n_feature keywords browse-bin%3A4357984011.

* cited by examiner

FIREARM ACCESSORY MOUNT

CROSS-REFERENCE TO RELATED APPLICATIONS

This application is a continuation-in-part of U.S. patent application Ser. No. 29/575,465 filed Aug. 25, 2016(now U.S. Design Pat. No. D802,077), and titled "FIREARM ACCESSORY MOUNT," the disclosure of which is hereby incorporated by reference in its entirety.

BACKGROUND

Automatic firearms are configured to fire multiple rounds of ammunition upon a single trigger pull. Automatic weapons are often referred to as machine guns. Machine guns are often fed by an ammunition belt containing multiple rounds of ammunition. The belt requires an operator to lift a top cover on the machine gun to replace and install a new ammunition belt. Because machine guns discharge a high number of rounds in a short time period, the barrels of machine guns are often quickly removable so as to allow the operator to remove the barrel to prevent damage due to heat build-up. Therefore, many machine guns are designed to allow the operator to quickly access the barrel connection point with the firearm receiver to quickly install or release the barrel from the machine gun. Further, like other firearms, machine guns can include a primary sighting device (e.g., telescopic scopes, red dot, etc.) to allow the operator to more effectively aim the firearm. Often secondary sights, in the form of thermal vision, night vision, etc., are also used. Such secondary sights must be positioned toward the front of the firearm with respect to the primary sighting device.

Because many machine guns require a movable top cover and access to the barrel, mounting sights (i.e., primary and secondary) to the firearm is difficult without restricting necessary access to important parts of the firearm. Therefore, improvements are needed.

SUMMARY

The present disclosure relates generally to a firearm accessory mount for a firearm. In one possible configuration, and by non-limiting example, the firearm accessory mount is for a machine gun and includes a pivoting accessory attachment portion.

In one aspect of the present disclosure, a firearm accessory is disclosed. The firearm accessory includes a firearm attachment portion that is configured to attach to a firearm. The firearm attachment portion defines a barrel passage that defines a barrel passage axis. The barrel passage is configured to receive at least a portion of a firearm barrel. The firearm accessory includes an accessory mounting portion that is pivotally attached to the firearm attachment portion. The accessory mounting portion is movable between an open position and a closed position. When in the open position, the accessory mounting portion is positioned away from the barrel passage, and when in the closed positioned, the accessory mounting portion is positioned at least partially around the barrel passage.

In another aspect of the present disclosure, a firearm is disclosed. The firearm includes a receiver having a trigger mechanism and a barrel attached to a front end of the receiver. The firearm includes a gas tube attached the front end of the receiver. The gas tube is generally parallel with the barrel. The firearm includes a firearm attachment secured at least partially to the gas tube. The firearm attachment includes a firearm attachment portion that defines a barrel passage which defines a barrel passage axis. The barrel passage is configured to receive at least a portion of the firearm barrel. The firearm attachment includes an accessory mounting portion pivotally attached to the firearm attachment portion. The accessory mounting portion is movable between an open position and a closed position. When in the open position, the accessory mounting portion is positioned away from the barrel passage. When in the closed position, the accessory mounting portion is positioned at least partially around the barrel passage.

In one aspect of the present disclosure, a firearm accessory is disclosed. The firearm accessory includes a firearm attachment portion that is configured to attach to a firearm. The firearm attachment portion defines a longitudinal firearm accessory axis. The firearm accessory includes an accessory mounting portion that is pivotally attached to the firearm attachment portion. The accessory mounting portion is pivotable about a pivot axis that is generally parallel with the longitudinal firearm accessory axis. The firearm accessory includes a latch for receiving and securing the accessory mounting portion to the firearm attachment portion.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
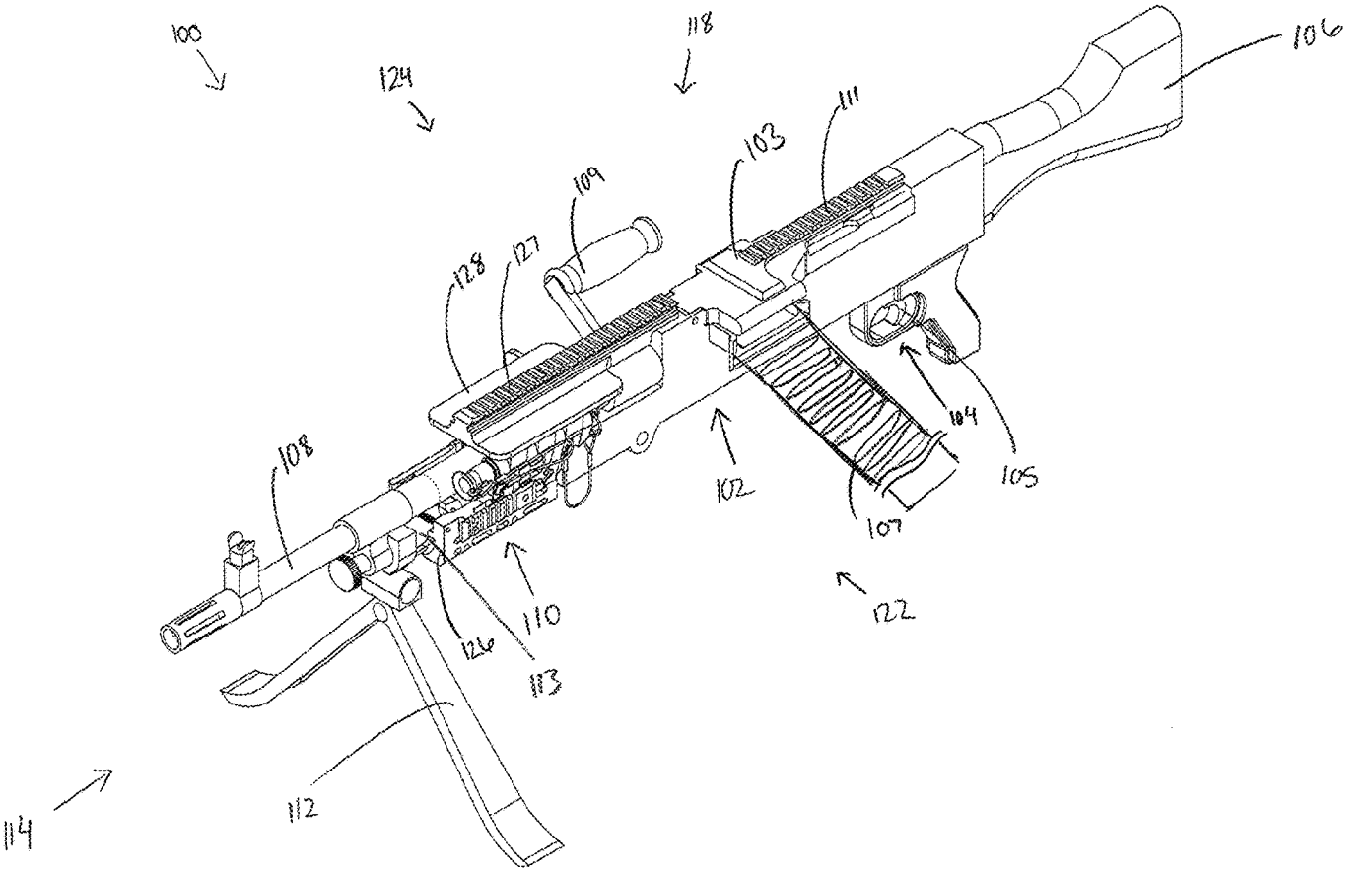
FIG. 1 illustrates a perspective view of an example firearm, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The firearm accessory mount described herein is configured to improve the ability to mount a primary sighting device and/or secondary sighting device to a machine gun. Specifically, the firearm accessory mount is configured to pivot so as to allow for removal of the barrel of the machine gun and also allow unencumbered access to the top cover of the firearm for effortless loading and unloading of an ammunition belt.

Figure 2:
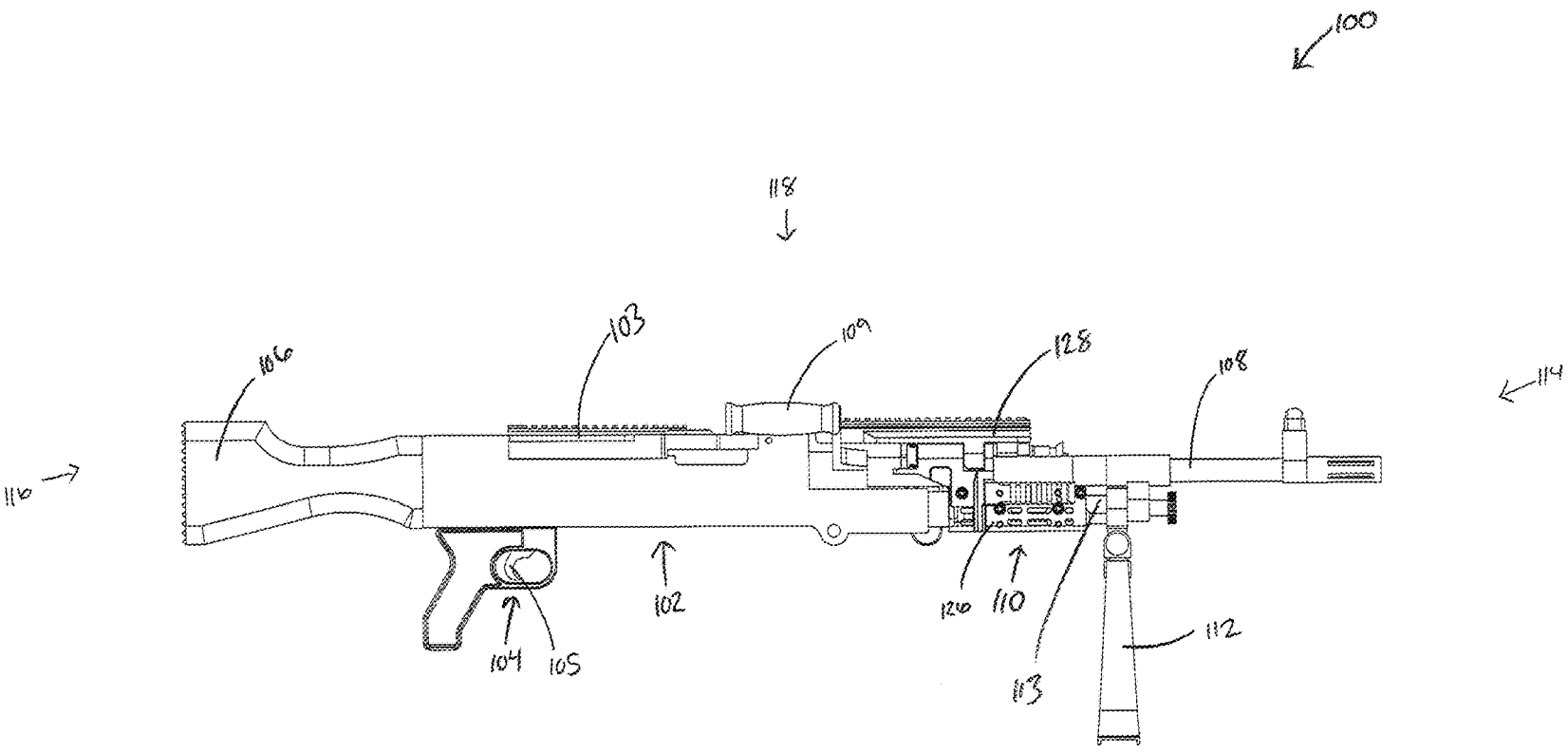
FIG. 2 illustrates a right side view of the example firearm of FIG. 1.

FIG. 1 illustrates a perspective view of a firearm 100, according to one embodiment of the present disclosure. FIG. 2 shows a right side view of the firearm. In this example, the firearm 100 includes a receiver 102, a trigger mechanism 104, a stock 106, a barrel 108, a firearm accessory mount 110, and a bipod 112.

The firearm 100 is defined by a front 114, a rear 116, a top 118, a bottom 120, a left side 122, and a right side 124. Throughout this disclosure, references to orientation (e.g., front(ward), rear(ward), in front, behind, above, below, high, low, back, top, bottom, under, underside, etc.) of structural components shall be defined by that component's positioning in FIG. 1 relative to, as applicable, the front 114, the rear 116, the top 118, the bottom 120, the left side 122, and the right side 124 of the firearm 100, regardless of how the firearm 100 may be held and regardless of how that component may be situated on its own (i.e., separated from the firearm 100).

In some examples, the firearm 100 is configured to operate in an automatic mode. In automatic mode, multiple rounds of ammunition can be discharged from the firearm 100 upon a single pull of the trigger mechanism 104.

The firearm 100 can be of a variety of types. Examples of a firearm include handguns, rifles, shotguns, carbines, and personal defense weapons. In at least one embodiment, the firearm is an FN Herstal M240B machine gun. In certain examples, the firearm fires a 7.62×51 mm NATO cartridge and is fed by an ammunition belt 107.

The receiver 102 is configured to house a firing mechanism (not shown) and associated components as found in, for example, machine guns and their variants. The firing mechanism is in communication with the trigger mechanism 104. In the depicted example, the receiver 102 includes a top cover 103 that is movable between a raised position and a lowered position. In some examples, the top cover 103 can include a picatinny rail 111 for mounting firearm accessories thereto (e.g., sights such as a telescopic scope). In FIGS. 1 and 2, the top cover 103 is shown in the lowered position. The top cover 103 is movable so that the ammunition belt 107 can be fed into the receiver 102 and under the top cover 103 for firing.

The trigger mechanism 104 includes a trigger bow 105 configured to be pulled by the finger of the shooter (e.g., the index finger) to initiate the firing cycle sequence of the firearm 100. The trigger mechanism 104 is mounted to the receiver 102. The trigger mechanism 104 is configured to discharge the firearm 100 when a predetermined amount of force is applied to the trigger bow 105.

The stock 106 is configured to be positioned at the rear 116 of the firearm 100. The stock 106 provides an additional surface for the shooter to support the firearm 100, preferably against the shooter's shoulder. In certain examples, the stock 106 is removably mounted to the receiver 102.

The barrel 108 is positioned at the front 114 of the firearm 100 and is configured to be installed on the receiver 102. The barrel 108 provides a path to release an explosion gas and propel a projectile therethrough. In certain examples, the barrel 108 includes an accompanying assembly that includes one or more of a gas block (not shown) and a gas tube 113. The gas tube 113 is generally aligned with the barrel 108 and is configured to route gases created by the detonation of an ammunition cartridge from the barrel 108 back to the receiver 102 so as to aid in resetting the firing mechanism. In certain examples, the barrel 108 is quickly removable from the firearm 100. In the depicted example, the barrel 108 includes a handle 109 attached thereto. The handle 109 allows the shooter to quickly remove the barrel 108 from the firearm 100 without having to contact the potentially hot barrel 108.

The firearm accessory mount 110 provides a point of support for the shooter of the firearm 100 and can be held by the shooter's hand as well as providing surfaces for mounting firearm accessories. The firearm accessory mount 110 includes a firearm attachment portion 126 and an accessory mounting portion 128. The firearm attachment portion 126 is fixedly mounted to the firearm 100, specifically at least partially around the barrel 108. In certain examples, the firearm attachment portion 126 is fixed to the gas tube 113 of the firearm 100. The accessory mounting portion 128 is pivotally attached to the firearm attachment portion 126. Firearm accessories, such as sights, can be mounted to the accessory mounting portion 128 which can include an accessory rail 127 (i.e. a picatinny rail). Further, the accessory mounting portion 128 can be configured to be pivotable between an open position and a closed position. As shown in FIGS. 1 and 2, the accessory mounting portion 128 is shown in the closed position.

The bipod 112 is configured to aid in supporting the firearm 100 on a surface. The bipod 112 helps to stabilize the firearm 100 during operation so as to allow the shooter to be more accurate. In certain examples, the bipod 112 can be removable from the firearm. In other examples, the bipod 112 can be collapsible.

Figure 3:
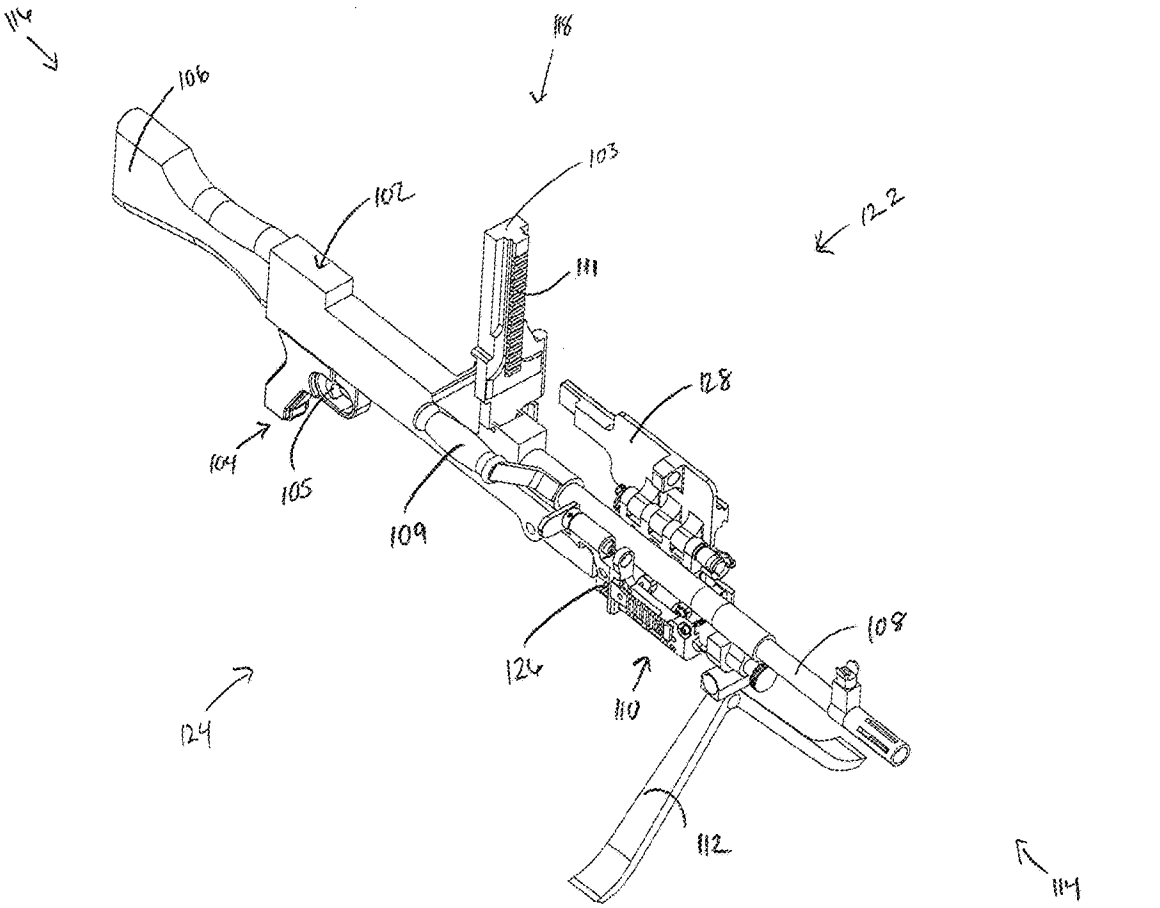
FIG. 3 illustrates a perspective view of the example firearm of FIG. 1 with a top cover in the raised position and a firearm accessory mount in an open position.
Figure 4:
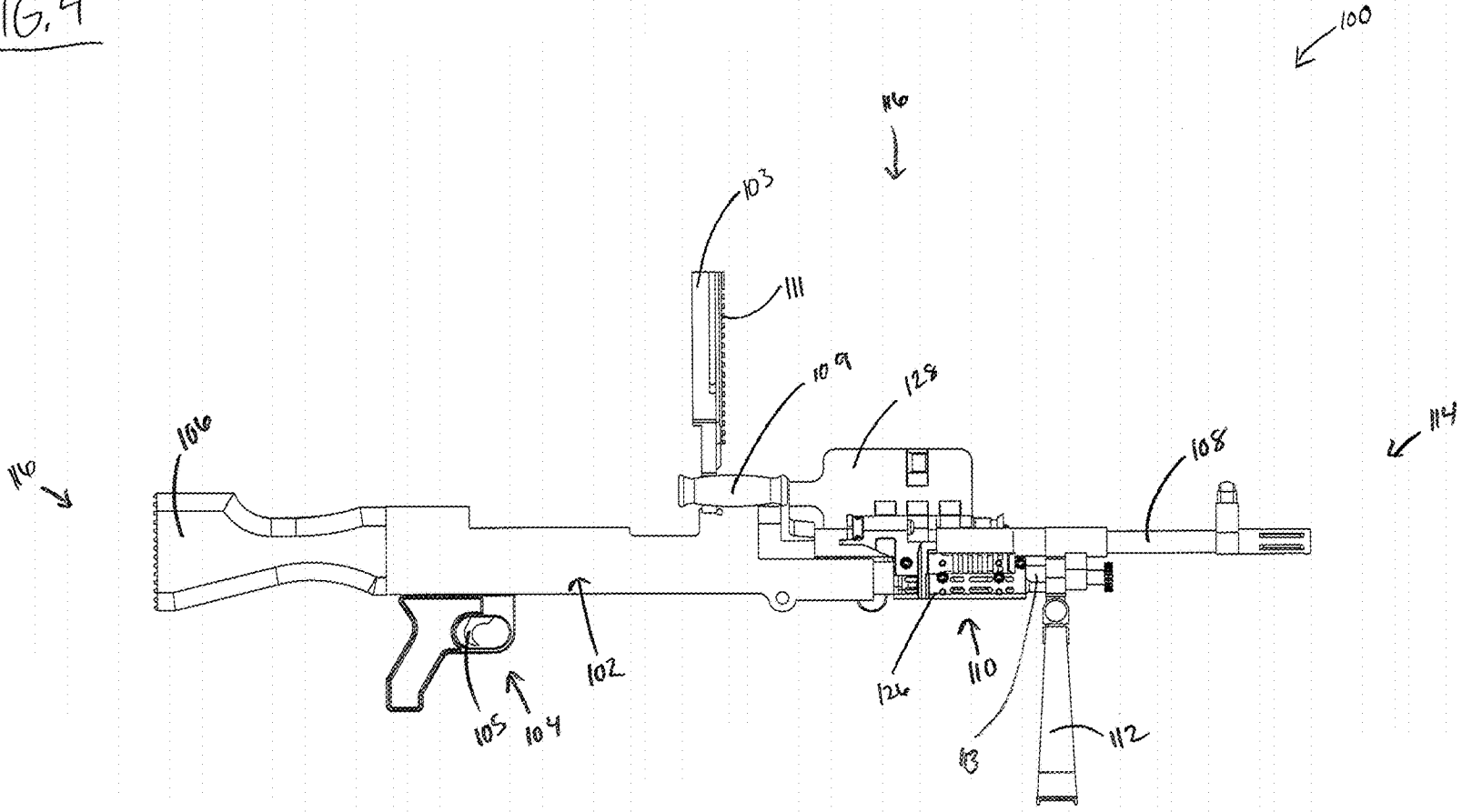
FIG. 4 illustrates a right side view of the example firearm of FIG. 1 with the top cover in the raised position and a firearm accessory mount in an open position.

FIGS. 3-4 show the firearm 100 with the top cover 103 of the receiver 102 in the raised position and the accessory mounting portion 128 of the firearm accessory mount 110 in the open position. When the top cover 103 of the receiver 102 is positioned in the raised position, the shooter can reload the firearm 100 with a new ammunition belt 107.

To avoid potential interferences between firearm accessories mounted on the top cover 103 and on the accessory mounting portion 128 of the firearm accessory mount 110, the accessory mounting portion 128 is pivotable away from the barrel 108 to a side of the firearm 100. This is particularly advantageous when the top cover 103 is in the raised position during a reload. In the depicted example, the accessory mounting portion 128 is pivotable to an open position to the left side 122 of the firearm 100. In other examples, the accessory mounting portion 128 is pivotable to the right side 124 of the firearm 100.

Further, the accessory mounting portion 128 of the firearm accessory mount 110 also pivots to a side of the firearm 100 to allow the shooter to remove the barrel 108 from the firearm 100 by using of the handle 109. When removing the barrel 108, the shooter rotates the barrel 108 about an axis defined by the barrel 108 and then moves the barrel toward the front 114 of the firearm 100. As shown in FIG. 3, when in the open position, the accessory mounting portion 128 of the firearm accessory mount 110 is positioned out of the way of the barrel 108 and handle 109 to allow the shooter easy and quick access to the barrel 108.

Figure 5:
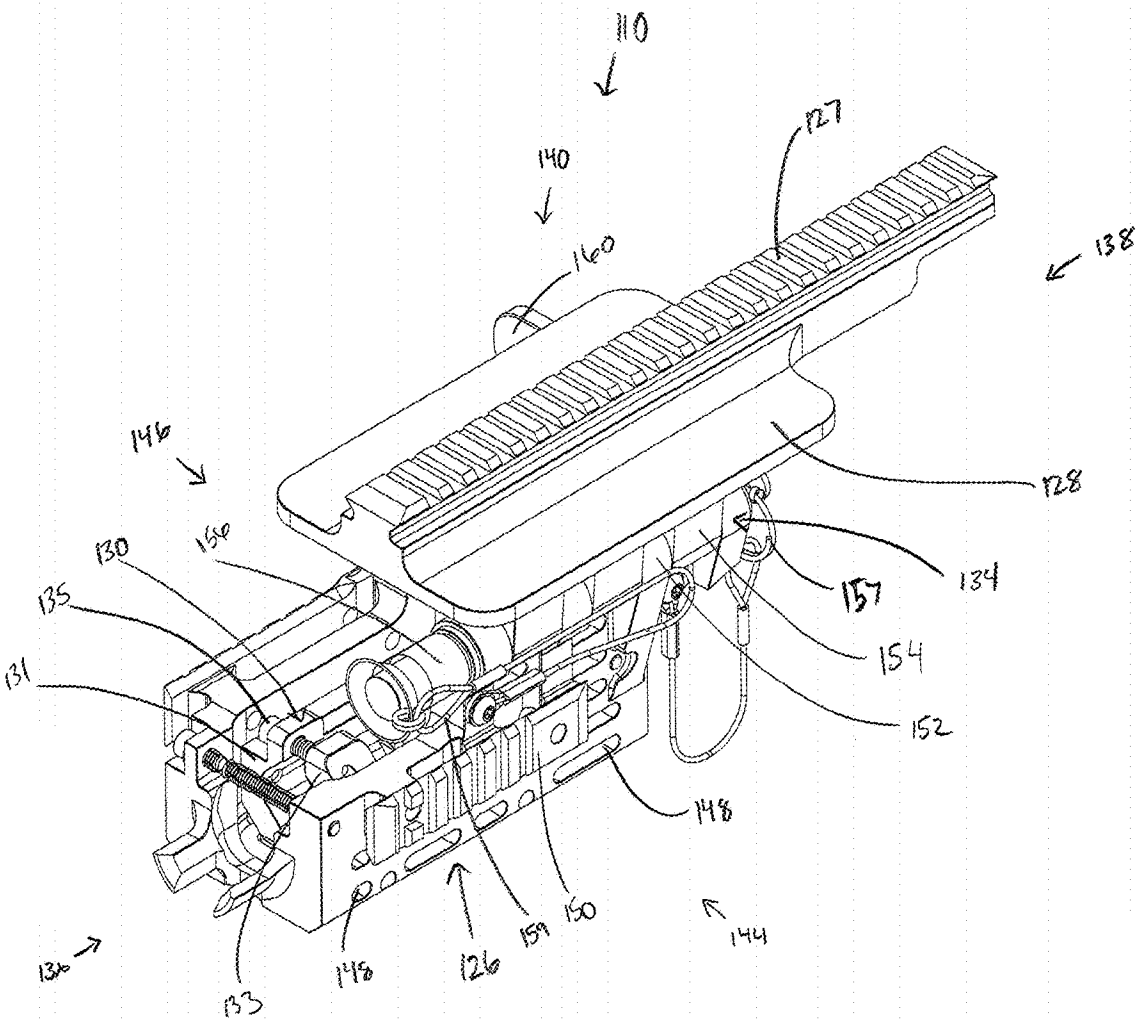
FIG. 5 illustrates a perspective view of a firearm accessory mount in a closed position, according to one embodiment of the present disclosure.
Figure 6:
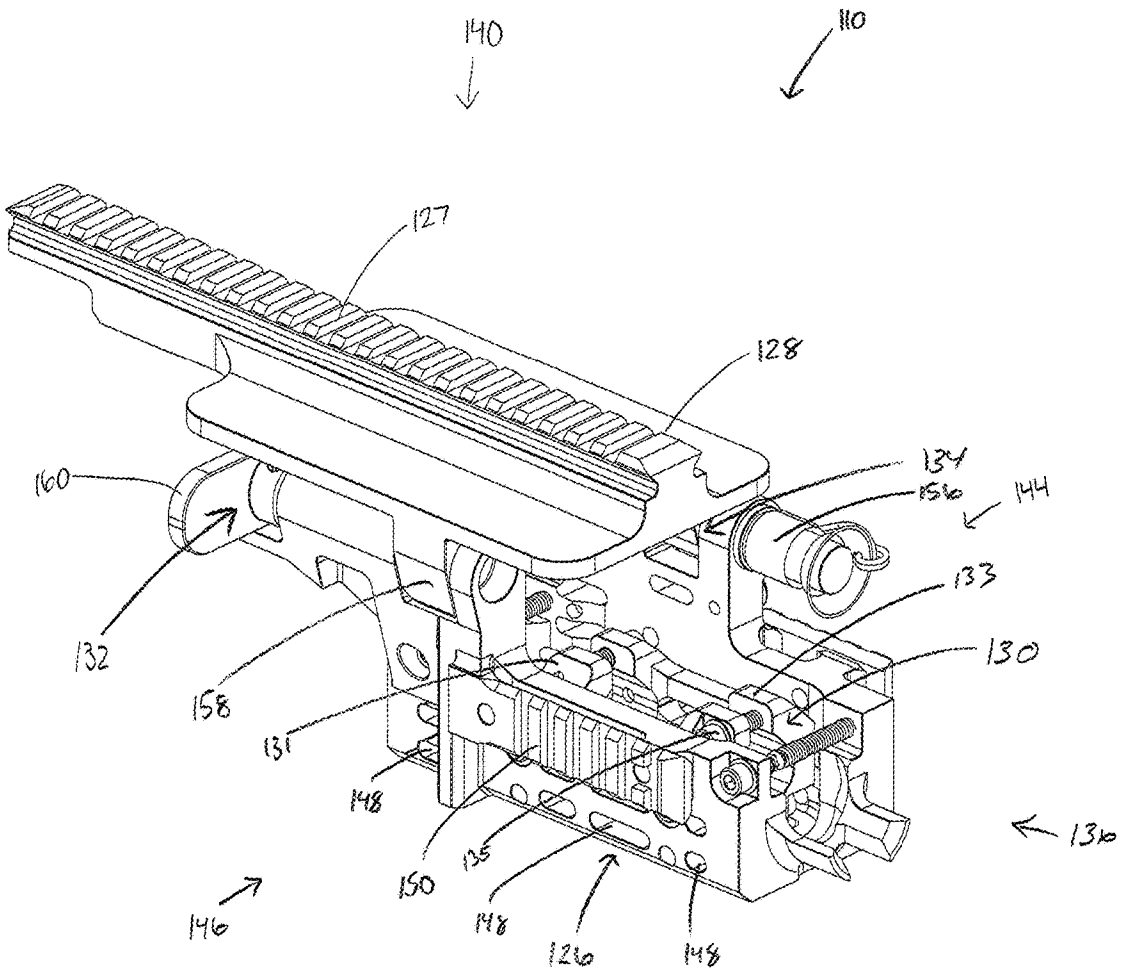
FIG. 6 illustrates another perspective view of the firearm accessory mount of FIG. 5 in the closed position.
Figure 7:
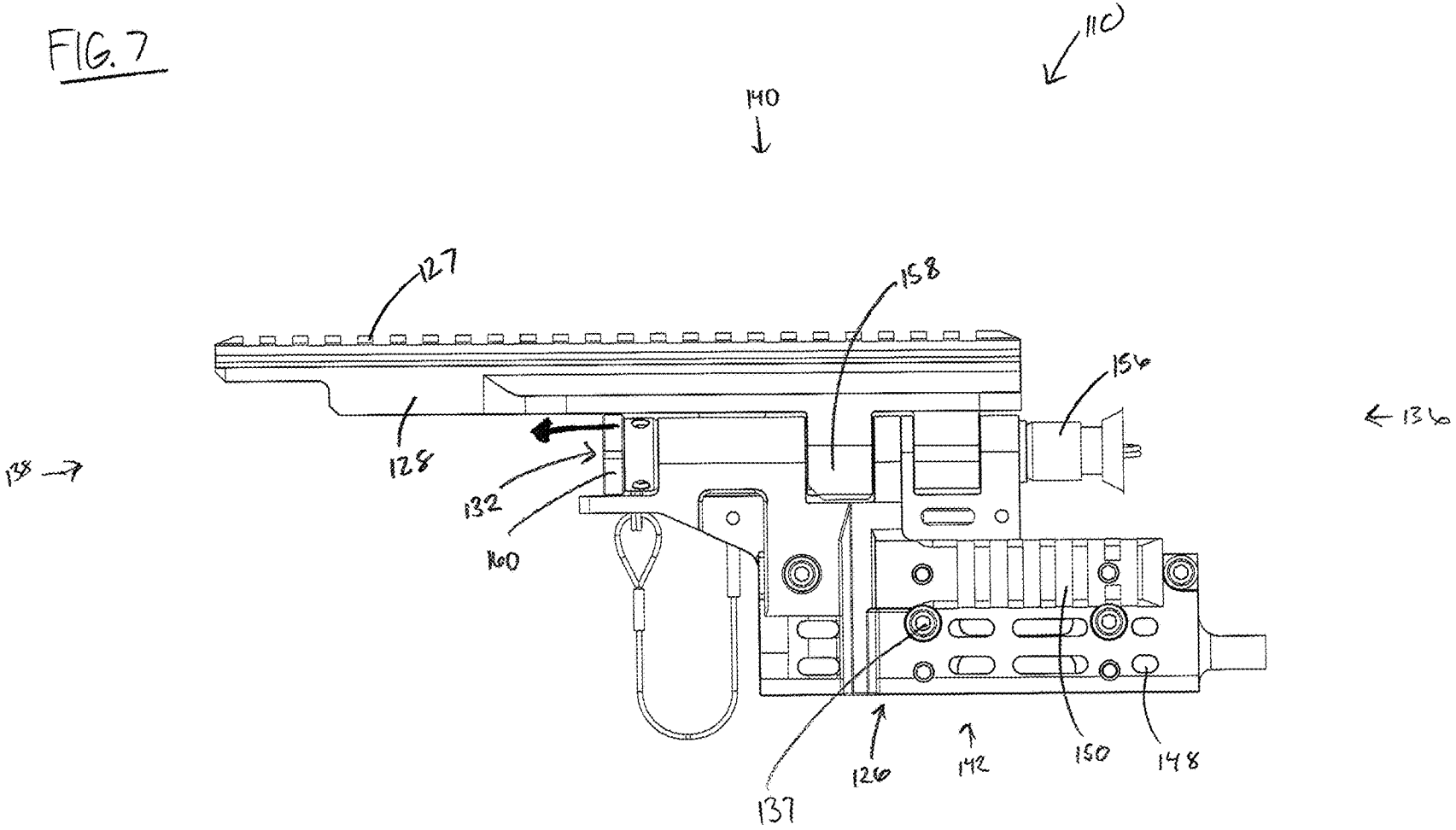
FIG. 7 illustrates a right side view of the firearm accessory mount of FIG. 5 in the closed position.
Figure 8:
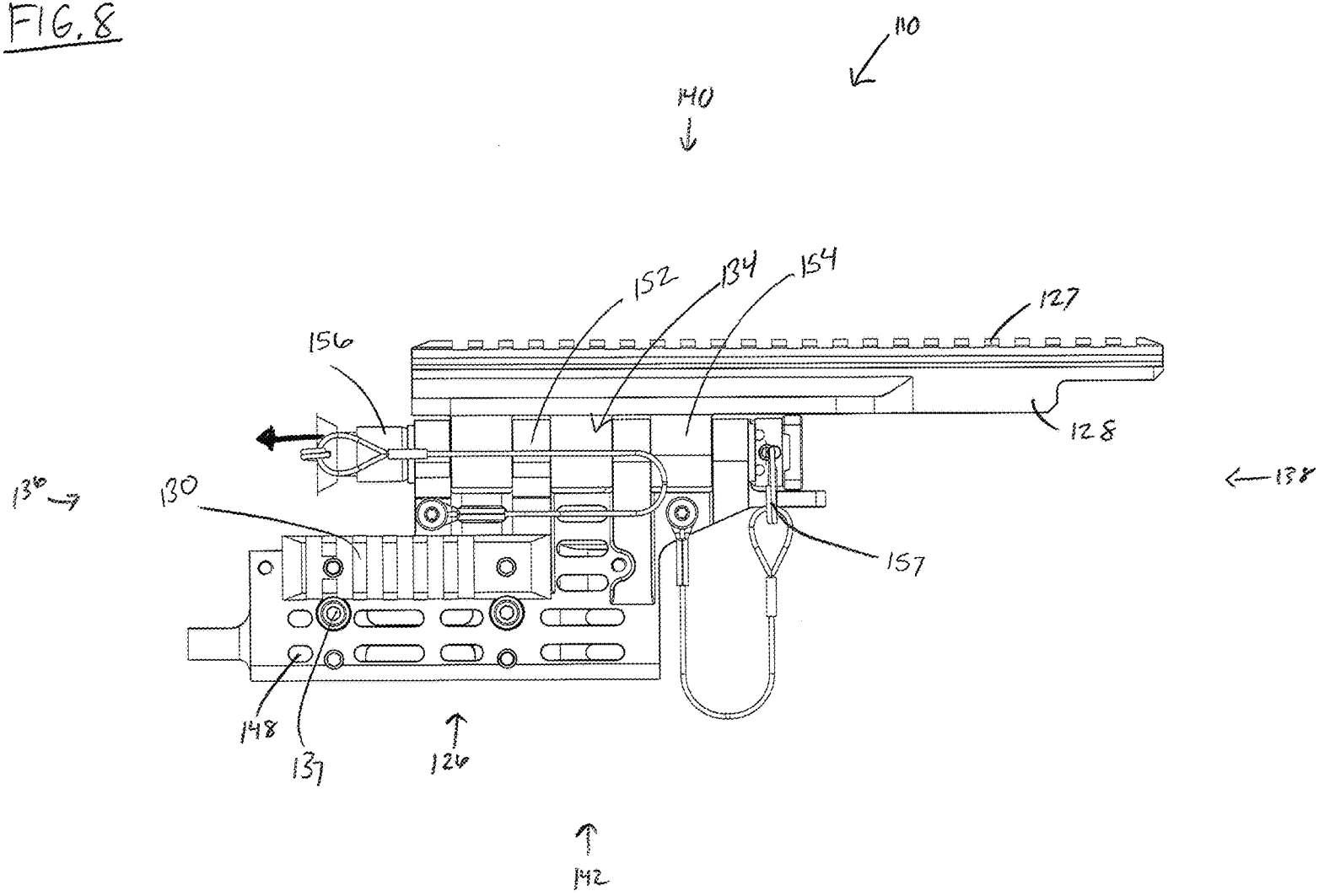
FIG. 8 illustrates a left side view of the firearm accessory mount of FIG. 5 in the closed position.

FIGS. 5 and 6 show perspective views of the firearm accessory mount 110. FIG. 7 shows a right side view and FIG. 8 shows a left side view. As shown, the accessory mounting portion 128 is in the closed position. The firearm accessory mount 110 includes the firearm attachment portion 126, the accessory mounting portion 128, a gas tube sleeve 130, a latch 132, and a hinge 134.

The firearm accessory mount 110 is defined by a front 136, a rear 138, a top 140, a bottom 142, a left side 144, and a right side 146, each corresponding with the front 114, the rear 116, the top 118, the bottom 120, the left side 122, and the right side 124 of the firearm 100 as described above.

The firearm attachment portion 126 is configured to interface with the firearm 100 and fixedly secure the firearm accessory mount 110 to the firearm 100. Specifically, the firearm attachment portion 126 is configured to be attached to the gas tube sleeve 130 so as to secure the firearm accessory mount 110 to the firearm 100. In certain examples, the firearm attachment portion 126 is separable between two halves, the two halves being securable around a portion of the firearm 100. The firearm attachment portion 126 includes a plurality of apertures 148 and a pair of side accessory rails 150. In some examples the firearm attachment portion 126 defines a general longitudinal firearm accessory axis that runs the length of the firearm attachment portion 126.

The apertures 148 can be positioned in a variety of different positions on the firearm attachment portion 126. In certain examples, the apertures 148 are at least partially ornamental in nature. In other examples, the apertures 148 provide weight savings for the firearm accessory mount 110 while simultaneously allowing heat generated by the barrel 108 and other portions of the firearm 100 to escape the firearm attachment portion 126.

The side accessory rails 150 are configured to receive firearm accessories, such as lights. In certain examples, the side accessory rails 150 are picatinny rails. The side accessory rails 150 can be positioned on both the left and right sides 144, 146 or just on one of the sides 144, 146 of the firearm accessory mount 110.

The firearm attachment portion 126 can also include a hinge extension 152 that is configured to mate with a similar hinge extension 154 of the accessory mounting portion 128. Further, the firearm attachment portion 126 includes a least a portion of the latch 132 attached thereto.

The accessory mounting portion 128 includes the accessory rail 127 disposed on a top surface thereof. The accessory mounting portion 128 is pivotally attached to the firearm attachment portion 126 via the hinge 134. In some examples, the accessory mounting portion 128 includes the hinge extension 154 that is configured to mate with the hinge extension 152 of the firearm attachment portion 126 to form the hinge 134. In some examples, the hinge 134 includes a removable pin 156 that includes an auto-locking feature that automatically retains the pin 156 within the hinge 134, thereby retaining the accessory mounting portion 128 hingedly attached to the firearm attachment portion 126.

The accessory mounting portion 128 also includes a latch extension 158 that is configured to interface with the latch 132 so as to allow the accessory mounting portion 128 to be locked into the closed position by the latch 132.

The gas tube sleeve 130 is configured to aid in attaching the firearm accessory mount 110 to the firearm 100. The gas tube sleeve 130 is configured to be removable from the firearm accessory mount 110. The gas tube sleeve 130 includes a first portion 131 and a second portion 133 that are connectable by way of a plurality of fasteners 135. The first and second portions 131, 133 are configured to be positioned around a portion of the firearm 100. The fasteners 135 are used to secure the first and second portions 131, 133 to one another, creating a clamp. In certain examples, the first and second portions 131, 133 are configured to be secured around the gas tube 113 of the firearm 100. Once secured around a portion of the firearm 100, the gas tube sleeve 130 is configured to be attached to the firearm attachment portion 126 via additional fasteners 137 (shown in FIGS. 7 and 8).

The latch 132 includes a pull lever 160 and a spring loaded pin 162. Upon movement of the pull lever 160 in a direction toward the rear 138 of the firearm accessory mount 110, the spring loaded pin 162 disengages from the latch extension 158 of the accessory mounting portion 128, allowing the accessory mounting portion 128 to pivot from the closed position to the open position. When moving from the open position to the closed position, the spring loaded pin 162 reengages the latch extension 158 of the accessory mounting portion 128 so as to lock the accessory mounting portion 128 in the closed position.

The hinge 134 allows the accessory mounting portion 128 to be both pivotable about the firearm attachment portion 126 and removable from the firearm attachment portion 126. The pin 156 of the hinge 134 is configured to be quickly removable by the shooter so as to allow the shooter to remove the firearm attachment portion 126. In some embodiments, removal of the firearm attachment portion 126 may be desired for shipment or travel, particularly if an accessory such as a sighting device is attached to the firearm attachment portion 126. In certain examples, a retaining ring 157 may be attached to end of the pin 156 to aid in accidental removal of the pin 156 from the hinge 134. In other examples, the pin 156 can include a leash 159 attached thereto and to the firearm attachment portion 126.

Figure 9:
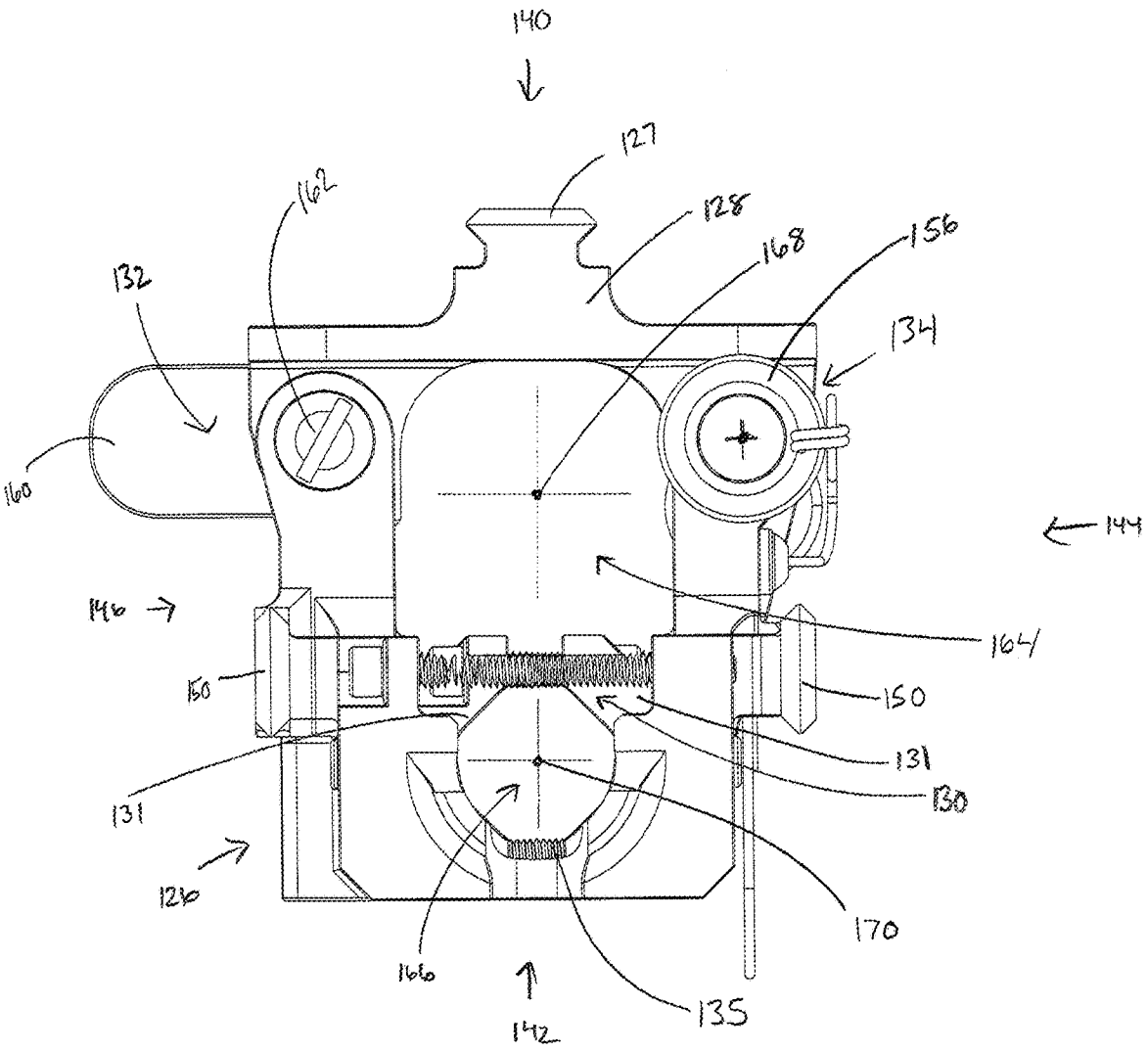
FIG. 9 illustrates a front view of the firearm accessory mount of FIG. 5 in the closed position.
Figure 10:
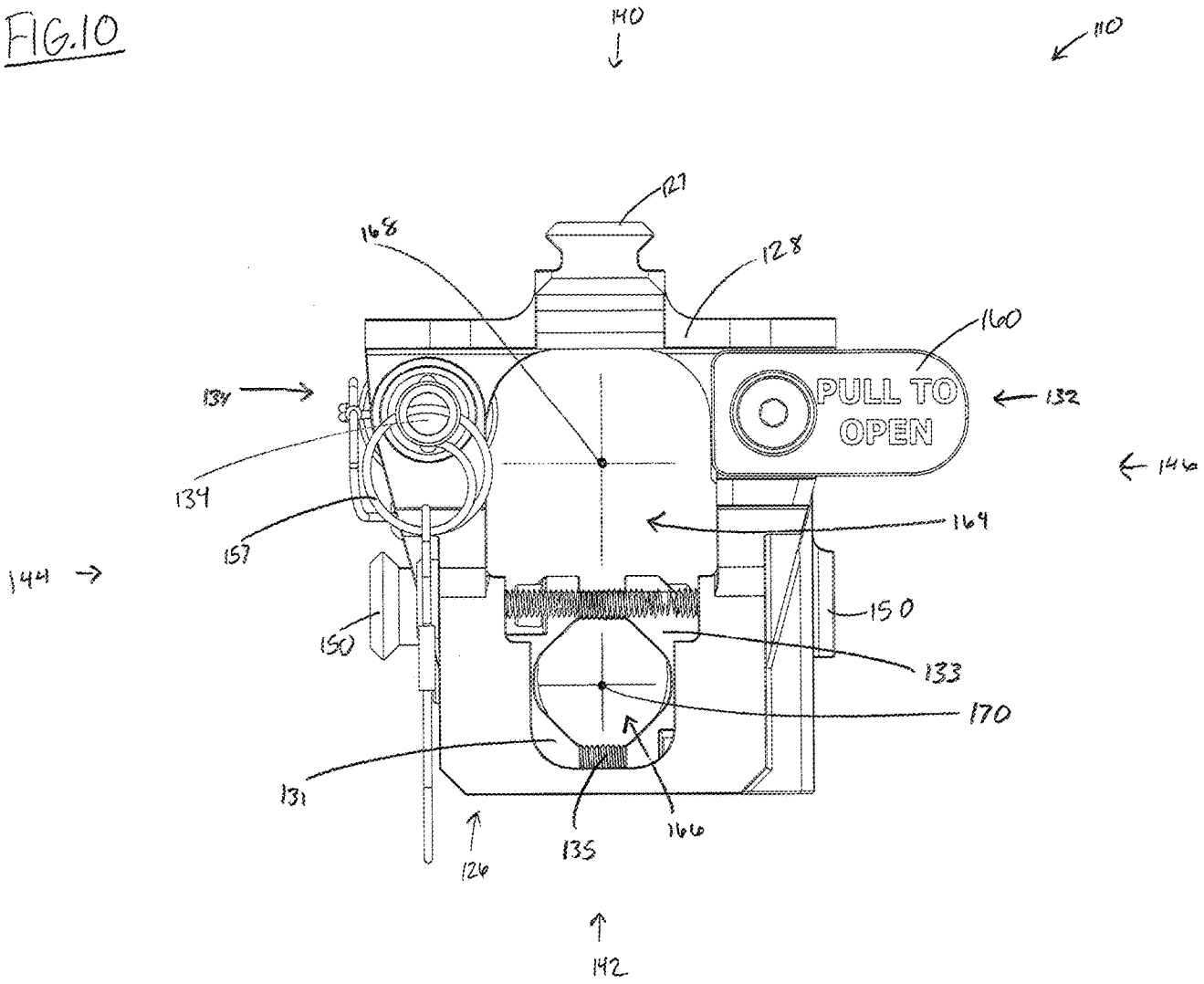
FIG. 10 illustrates a rear view of the firearm accessory mount of FIG. 5 in the closed position.
Figure 11:
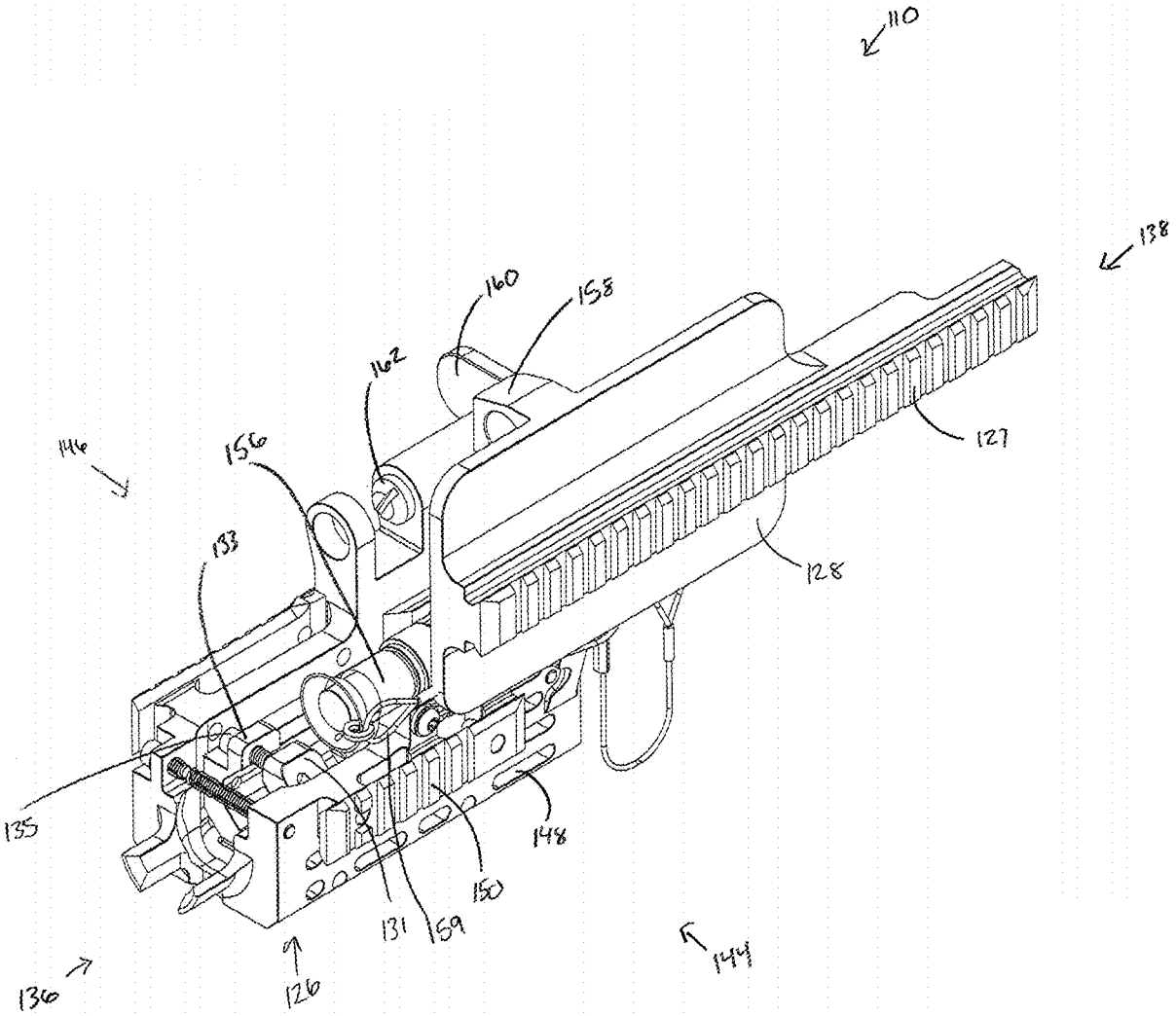
FIG. 11 illustrates a perspective view of the firearm accessory mount of FIG. 5 in the open position.
Figure 12:
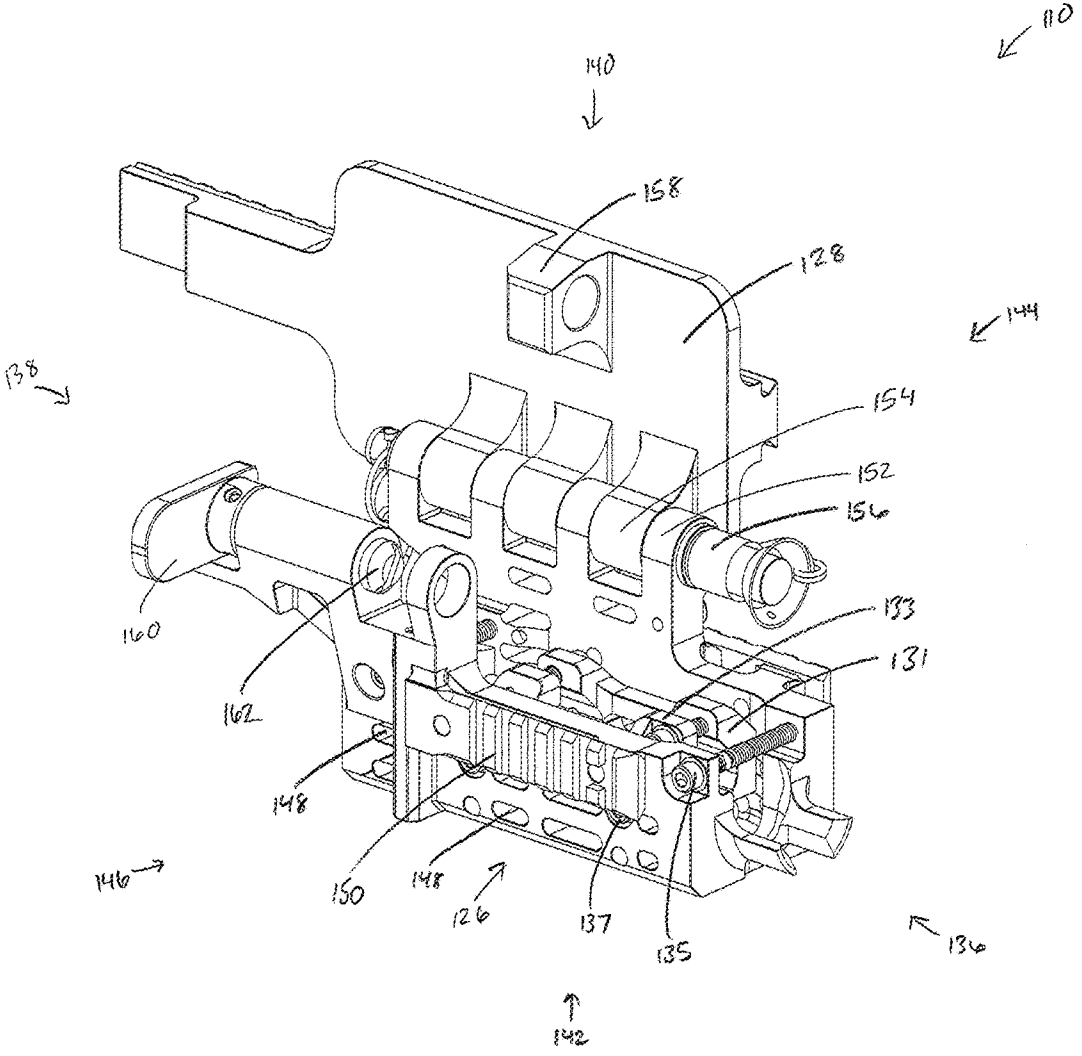
FIG. 12 illustrates another perspective view of the firearm accessory mount of FIG. 5 in the open position.

FIG. 9 shows a front view of the firearm accessory mount 110. FIG. 10 shows a rear view of the of the firearm accessory mount 110. The firearm accessory mount 110 also includes a barrel passage 164 and a gas tube passage 166 defined by the firearm attachment portion 126. The barrel passage 164 is shown positioned above the gas tube passage 166, toward the top 140 of the firearm accessory mount 110.

The barrel passage 164 defines a barrel passage axis 168. The barrel passage 164 is configured to receive at least a portion of a firearm barrel 108. However, depending on the size of the firearm and associated barrel, the firearm accessory mount 110 is configured to receive a wide range of barrel sizes generally within the barrel passage 164. The barrel passage 164 is bound to the firearm attachment portion 126, by the latch 132 at one side and the hinge 134 at an opposite side. In certain examples, the gas tube sleeve 130 defines a bottom side of the barrel passage 164. When in the closed position, the accessory mounting portion 128 defines a top side of the barrel passage 164.

The gas tube passage 166 defines a gas tube passage axis 170 that is generally parallel with the barrel passage axis 168. In certain examples, the gas tube passage 166 is defined by the first and second portions 131, 133 of the gas tube sleeve 130.

Figure 13:
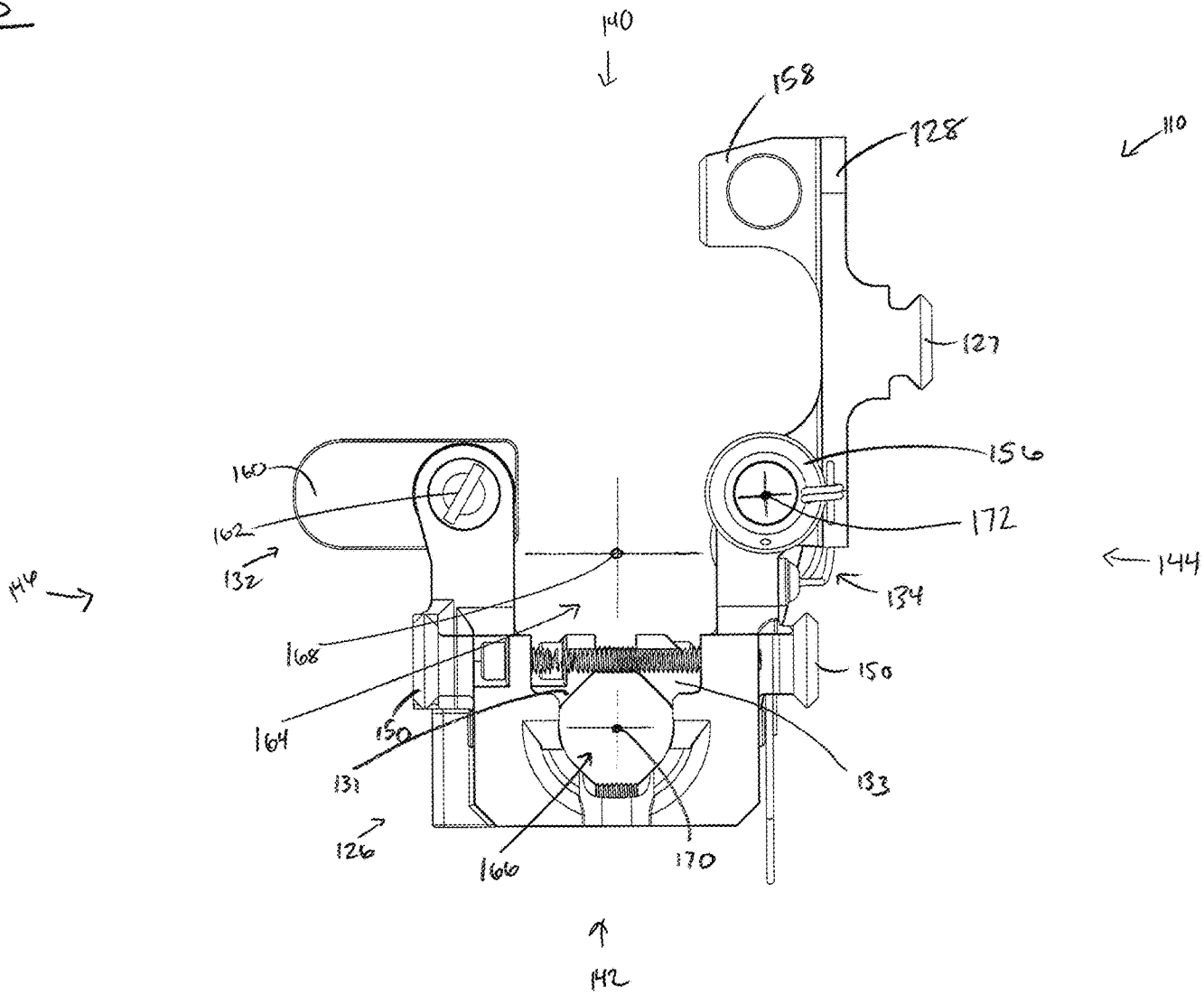
FIG. 13 illustrates a front view of the firearm accessory mount of FIG. 5 in the open position.
Figure 14:
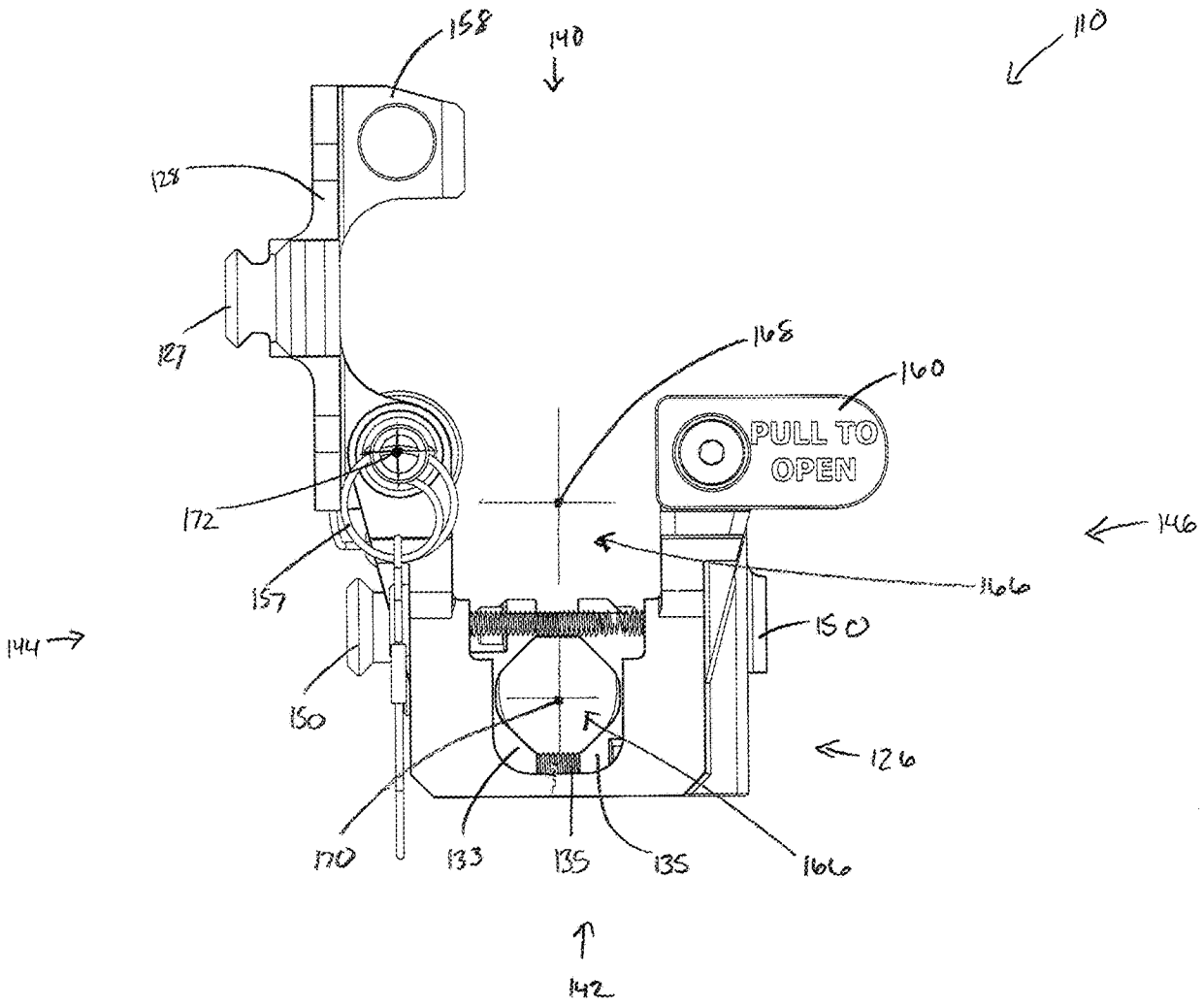
FIG. 14 illustrates a rear view of the firearm accessory mount of FIG. 5 in the open position.

FIGS. 11-14 show the firearm accessory mount 110 with the accessory mounting portion 128 in the open position. Specifically, as shown in FIGS. 13 and 14, when in the open position, the accessory mounting portion 128 is positioned away from the barrel passage 164 allowing the barrel passage 164 to be opened toward the top side 140 of the firearm accessory mount 110. The accessory mounting portion 128 is shown pivoted toward the left side 144 of the firearm accessory mount 110 about the hinge 134. The pin 156 of the hinge 134 defines a hinge axis 172 about which the accessory mounting portion 128 pivots. The hinge axis 172 is generally parallel with both the barrel passage axis 168 and the gas tube passage axis 170. However, the hinge axis 172 is offset toward the left side 144 of the firearm accessory mount 110 from the barrel passage axis 168 and the gas tube passage axis 170. In certain examples, the hinge axis 172 is offset toward the right side 146 of the firearm accessory mount 110 from the barrel passage axis 168 and the gas tube passage axis 170.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A firearm accessory comprising:

a firearm attachment portion configured to attach to a firearm, the firearm attachment portion defining a barrel passage that defines a barrel passage axis, the barrel passage being configured to receive at least a portion of a firearm barrel; and an accessory mounting portion pivotally attached to the firearm attachment portion, the accessory mounting portion being movable between an open position and a closed position, wherein, when in the open position, the accessory mounting portion is positioned away from the barrel passage, and wherein, when in the closed position, the accessory mounting portion is positioned at least partially around the barrel passage.

2. The firearm accessory of claim 1, wherein the accessory mounting portion is pivotable about a pivot axis that is generally parallel with the barrel passage axis.

3. The firearm accessory of claim 1, wherein the accessory mounting portion includes an accessory rail.

4. The firearm accessory of claim 3, wherein the rail is a picatinny rail.

5. The firearm accessory of claim 1, wherein the firearm attachment portion includes a latch for receiving and securing the accessory mounting portion in the closed position.

6. The firearm accessory of claim 5, wherein the latch is securable by way of a spring loaded shaft, wherein the spring loaded shaft is configured to engage at a portion of the accessory mounting portion and a portion of the firearm attachment portion.

7. The firearm accessory of claim 1, wherein the accessory mounting portion pivots about a hinge, and wherein the hinge include a removable hinge pin that is configured to engage both the accessory mounting portion and the firearm attachment portion.

8. The firearm accessory of claim 1, wherein the firearm attachment portion includes a first side and a second side, wherein the barrel passage is positioned between the first and second sides, and wherein the first and second sides include accessory rails.

9. The firearm accessory of claim 1, wherein the firearm attachment portion includes a plurality of apertures.

10. A firearm comprising:

a receiver having a trigger mechanism;

a barrel attached to a front end of the receiver;

a gas tube attached the front end of the receiver and being generally parallel with the barrel; and a firearm attachment secured at least partially to the gas tube, the firearm attachment including:

a firearm attachment portion defining a barrel passage that defines a barrel passage axis, the barrel passage being configured to receive at least a portion of the firearm barrel; and an accessory mounting portion pivotally attached to the firearm attachment portion, the accessory mounting portion being movable between an open position and a closed position, wherein, when in the open position, the accessory mounting portion is positioned away from the barrel passage, and wherein, when in the closed position, the accessory mounting portion is positioned at least partially around the barrel passage.

11. The firearm of claim 10, wherein the accessory mounting portion is pivotable about a pivot axis that is generally parallel with the barrel passage axis.

12. The firearm of claim 10, wherein the accessory mounting portion includes an accessory rail.

13. The firearm of claim 12, wherein the rail is a picatinny rail.

14. The firearm of claim 10, wherein the firearm attachment portion includes a latch for receiving and securing the accessory mounting portion in the closed position.

15. A firearm accessory comprising:

a firearm attachment portion configured to attach to a firearm, the firearm attachment portion defining a longitudinal firearm accessory axis;

an accessory mounting portion pivotally attached to the firearm attachment portion, the accessory mounting portion being pivotable about a pivot axis that is generally parallel with the longitudinal firearm accessory axis; and a latch for receiving and securing the accessory mounting portion to the firearm attachment portion;

wherein the accessory mounting portion includes an accessory rail.

16. The firearm accessory of claim 15, wherein the rail is a picatinny rail.

17. The firearm accessory of claim 15, wherein the accessory mounting portion pivots about a hinge, and wherein the hinge includes a removable hinge pin that is configured to engage both the accessory mounting portion and the firearm attachment portion.

* * * * *